United States Patent [19]

Smith

[11] Patent Number: 4,811,915

[45] Date of Patent: Mar. 14, 1989

[54] RIDER ROLL RELIEVING SYSTEM

[75] Inventor: R. Duane Smith, Fair Haven, N.Y.

[73] Assignee: The Black Clawson Company, Middletown, Ohio

[21] Appl. No.: 119,516

[22] Filed: Nov. 12, 1987

[51] Int. Cl.[4] ..... B65H 17/08

[52] U.S. Cl. ..... 242/66; 242/75.1; 242/75.51

[58] Field of Search ..... 242/66, 65, 75.1, 75.45, 242/75.51, 67.1 R, 75.2

[56] References Cited

U.S. PATENT DOCUMENTS 3,599,889 8/1971 Pfeiffer ..... 242/66

3,937,410 2/1976 Justus ..... 242/66

*Primary Examiner*—Stuart S. Levy

*Assistant Examiner*—Steven M. duBois

*Attorney, Agent, or Firm*—Biebel, French & Nauman

[57] ABSTRACT

A rider roll relieveing system includes a microprocessor for controlling the rider roll force applied to a roll of web material being wound which in turn controls the roll's density or hardness. The operator programs into the system the desired rider roll force or load at the start of the wind and a first diameter at which the rider roll relief is to begin. Also, the ending load at a second diameter at which relieving is to finish is programmed into the system. The microprocessor then provides for the progressive elief of the load as function of the roll's diameter, geometry, and weight between the two pre-stablished diameters to provide the desired hardness or the roll. The rider roll force is maintained constant until the web has been wound to the first diameter and after it has obtained the second diameter. The system digitally displays the winding roll's diameter and the rider roll force during the winding operation.

5 Claims, 4 Drawing Sheets

RIDER ROLL RELIEVING SYSTEM

BACKGROUND OF THE INVENTION

This invention relates to the winding of web rolls, and particularly to a method and apparatus for controlling the density or hardness of the rolls during the winding operation.

Typically, a surface type winder employs a rider roll or pressure roll to control the density or hardness of the winding roll of web material. The rider roll is either loaded or its weight relieved, usually by hydraulic or pneumatic cylinders, as the winding roll builds. The operator controls the winding roll's hardness by adjusting the pressure the rider roll exerts during winding by controlling these hydraulic or pneumatic cylinders. This can be a fixed contact pressure throughout the roll's build-up or the contact pressure can be varied on a straight line basis or by means of a curved cam to vary, usually to reduce, the hardness or density according to a predetermined formula or pattern as the roll builds and increases in diameter.

One problem associated with prior art rider roll control systems is their inability to control accurately and continuously the rider roll pressure throughout the winding process, from the very beginning to the end. Those prior art systems that employ a cam to control the rider roll pressure as a function of roll diameter, for example, must either change cams or accept a compromise in the manner in which the distribution of the roll density or hardness is controlled when changing the system from one size of roll to another or when winding different kinds of web materials since the shape of the cam is mechanically fixed.

SUMMARY OF THE INVENTION

The purpose of this invention is to make it easier for the operator to control the contact pressure of the rider or pressure roll not only at the start, but throughout the winding operation. This invention allows the operator to select the diameter of the winding roll at which this contact pressure will start to change (typically to relieve the loading force), and to allow the operator to predetermine the diameter and pressure at which the relieving operation will stop with the remaining pressure, or a preset minimum load, staying constant until the finish of the winding cycle.

In previous rider roll relieving systems, the operator could set a certain amount of rider roll loading at the start of winding and could change the amount of rider roll pressure during winding by changing the slope of a curve generated by a cam profile. In the present invention, the operator sets the contact pressure or loading value at the start of winding by inputting this value into a microprocessor. The operator also inputs into the microprocessor the diameter at which the relieving sequence is to start along with the loading value of the rider roll and the diameter at which the loading sequence is to stop. The rate at which rider roll pressure is relieved relative to the diameter of the roll between the first and second diameters, and indeed the slope of the relieving curve, can then be programmed into the microprocessor which in turn provides control signals to the valves that supply pneumatic or hydraulic pressure to the rider roll system.

Unlike previous systems, the operator of a winder including the present invention is provided with a readout of the amount of rider roll pressure being exerted on the winding roll at any given time during the winding process. This pressure readout may be either a calculated force or it may be a reading from one or more force transducers associated with the rider roll system. Another benefit of this invention is that it provides the operator a digital readout of the winding roll's diameter on a continuous basis.

This invention significantly improves the ability of the operator to control the operation of the winding machine and to produce a desired roll density during winding, and to reproduce this roll density consistently at any time.

Accordingly, it is an object of this invention to provide an improved rider roll relieving system including a pair of winding drums; a core on which a web is wound with the aid of the winding drums; a rider roll for applying pressure to the core, and the web as it is wound on the core, to control the internal tension of the web; and means for controlling the pressure applied by the rider roll to the web; the improvement comprising; means for sensing the diameter of the web as it is wound onto the core; means for selecting a first diameter where rider roll relieving action is to be commenced; means for selecting a maximum rider roll pressure; means for setting a second, larger diameter where rider roll relieving action is to be terminated; means for setting a minimum rider roll pressure to be maintained after the relieving action is terminated; means for providing control signals to said rider roll pressure controlling means for providing a pressure relieving action by controlling the rider roll pressure as a function of the diameter of the web to provide continuous rider roll pressure reduction as the web is wound between said first diameter and said second diameter while maintaining said maximum rider roll pressure until said first diameter is reached and maintaining said minimum rider roll pressure after said second diameter is reached.

Other objects and advantages of the invention will be apparent from the following description, the accompanying drawings and the appended claims.

DESCRIPTION OF THE PREFERRED EMBODIMENT

Figure 1:
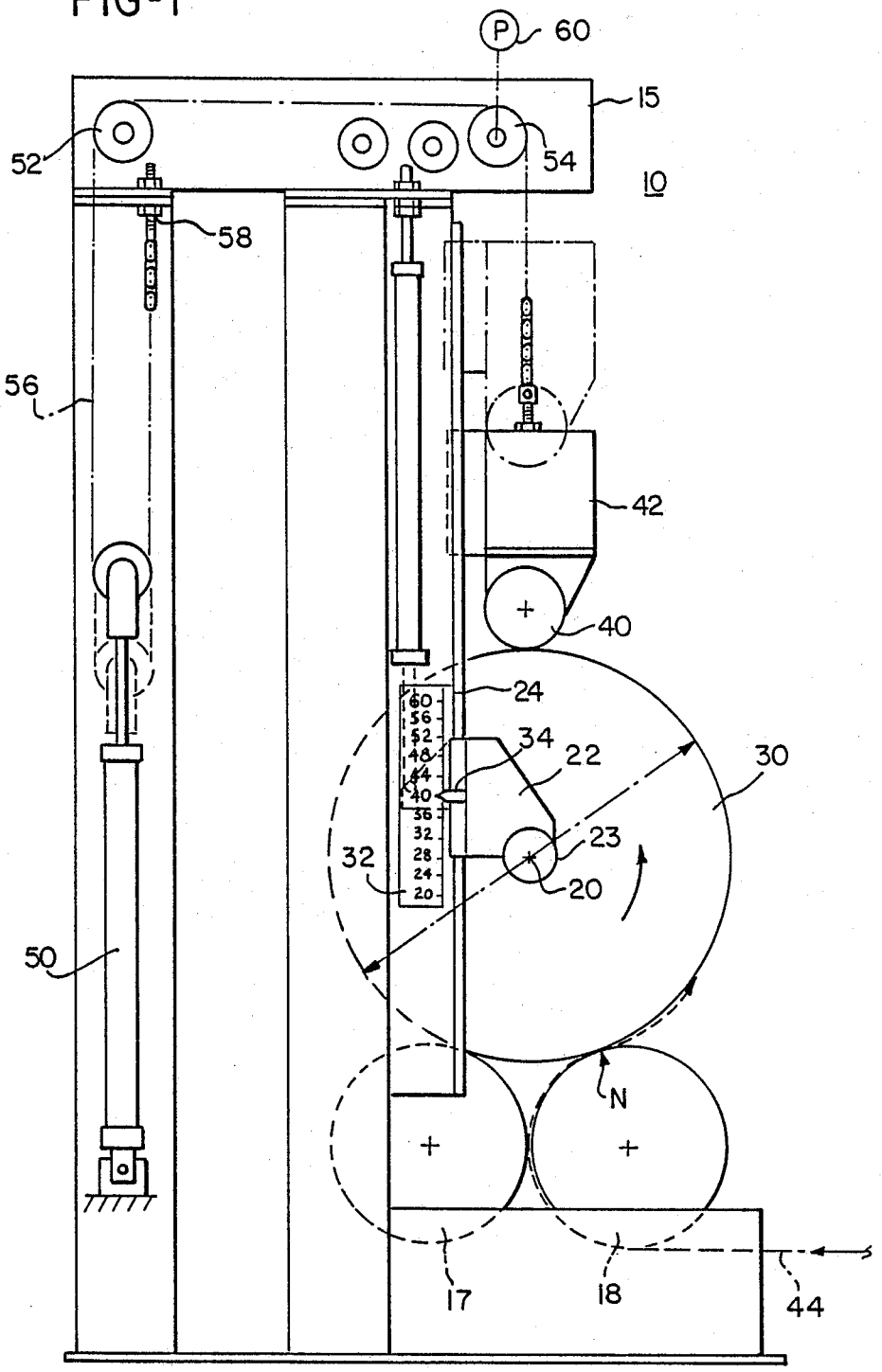
FIG. 1 is a side elevational view of a typical drum winder of the type employing this invention.

The winding assembly shown in FIG. 1 includes a frame 15, a pair of suitably driven winder drums 17,22, shafts or spindles 20 carried by a pair of slide arms vertically movable on frame mounted tracks for supporting the core 23 of a web roll 30. A scale 32 mounted on the frame 15 provides information on the diameter of the material wound on the web roll by reference to the indicator arrow 34 carried by the slide 32. A rider roll 40 is carried by a pair of slide brackets 42, also slidable mounted on tracks on the frame 15. It is understood that only one side of the assembly is shown in FIG. 1, but there are corresponding components, not shown, on the other side.

In a typical winding device, the rider roll 40 applies pressure to the web roll 30 as the web material 44 is wound on its core 23 to ensure that sufficient nip force N is available to wind the roll initially and to control the tightness or hardness of the material, such as paper, throughout the winding operation. As the winding of the roll progresses, less rider roll pressure is required because the weight of the roll itself will ensure sufficient nip pressure, but the relief of the rider roll pressure must be properly controlled to prevent sudden changes in web tension.

The weight of the rider roll 40, or the pressure it applies to the web roll, is controlled by hydraulic cylinders 50 connected to the rider roll 40 through a chain system that includes a pair of sprockets 52,54 and a chain 56 connected to the frame 15 at one end 58 and to the rider roll slide bracket 42 at its other end. The sprockets 52,54 on either side of the frame are connected by a torsion arm to provide for synchronizing the movement of both slide brackets 42. A potentiometer 60 is associated with one of the sprockets to provide an electronic signal indicating the location of the rider roll, and thus an indication of the diameter of the web roll. There are other components of the winding assembly that will be well known to those skilled in the art, but not shown or described in this specification.

Figure 2:
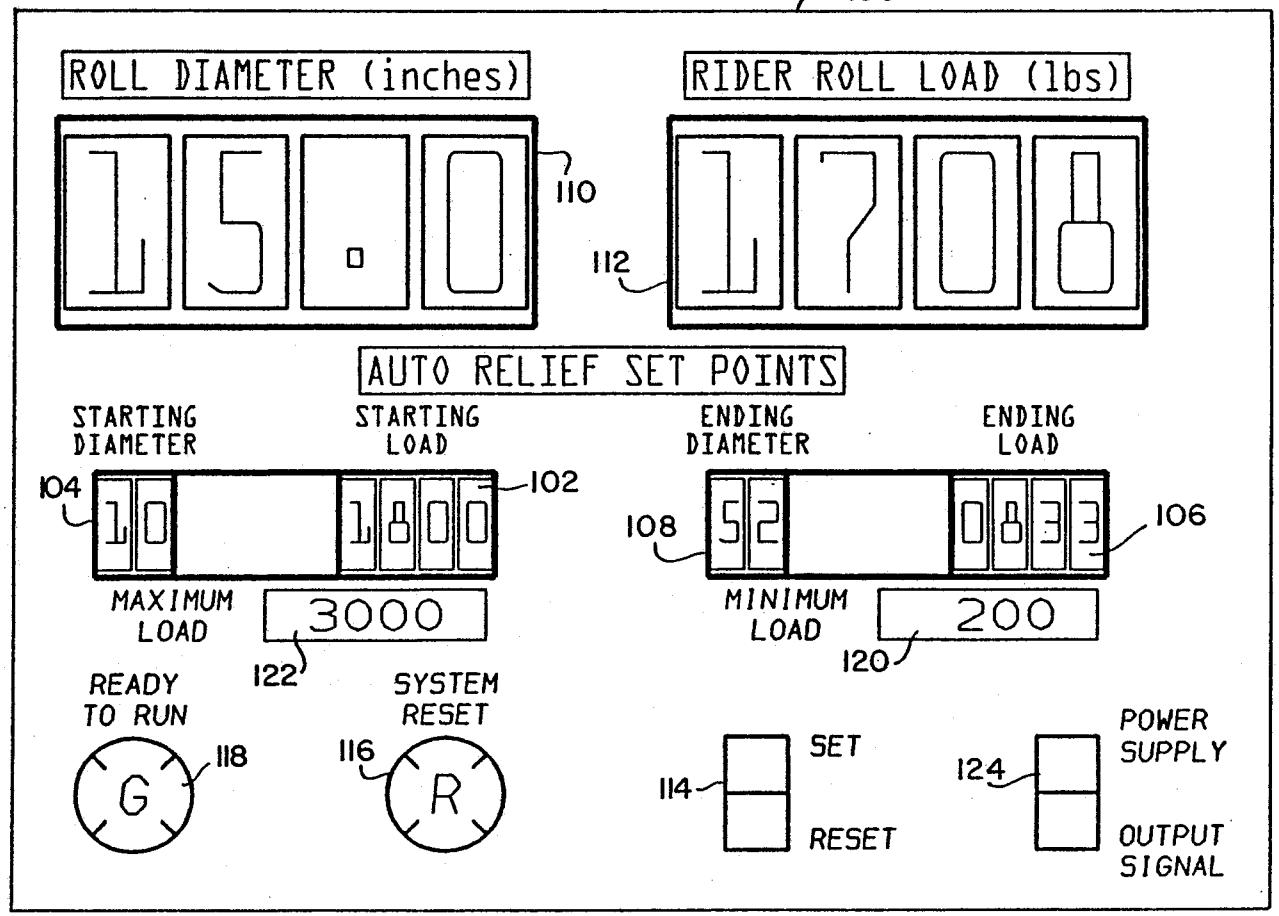
FIG. 2 represents the front or control panel of the rider roll controlling system of this invention.

FIG. 2 represents the front or control panel 100 of the rider roll controlling system. Thumbwheel switches 102 and 104 are used by the operator to set the starting load and the diameter at which the relieving action of the system will start. Thumbwheel switches 106 and 108 are used by the operator to set the ending load and ending diameter. The actual web roll diameter is displayed on the readout device 110 and either a calculated or the actual rider roll load is displayed on readout device 112. A spring-loaded switch 114 is used to reset the system whenever the operator changes one of the thumbwheel switches and desires a recalculation. The red system reset lamp 116 will illuminate during the recalculation period, and after recalculation is completed, the green Ready to Run lamp 118 will light. During recalculation, if accomplished during the winding operation, the rider roll pressure will be maintained constant at its last calculated setting.

For many winding operations, it is undesirable for the rider roll to lift off the web roll during the winding process. The minimum pressure may be programmed into the control system and that pressure displayed at 120. The maximum rider roll pressure can also be set into the system and displayed at 122.

A double direction spring-loaded rocker switch 124 causes the display device 112 to show power supply voltage when pushed up, and the control or output voltage to the hydraulic valve controlling the cylinder when it is pushed down. In the neutral position, the rider load pressure is displayed on the meter 112.

Figure 3:
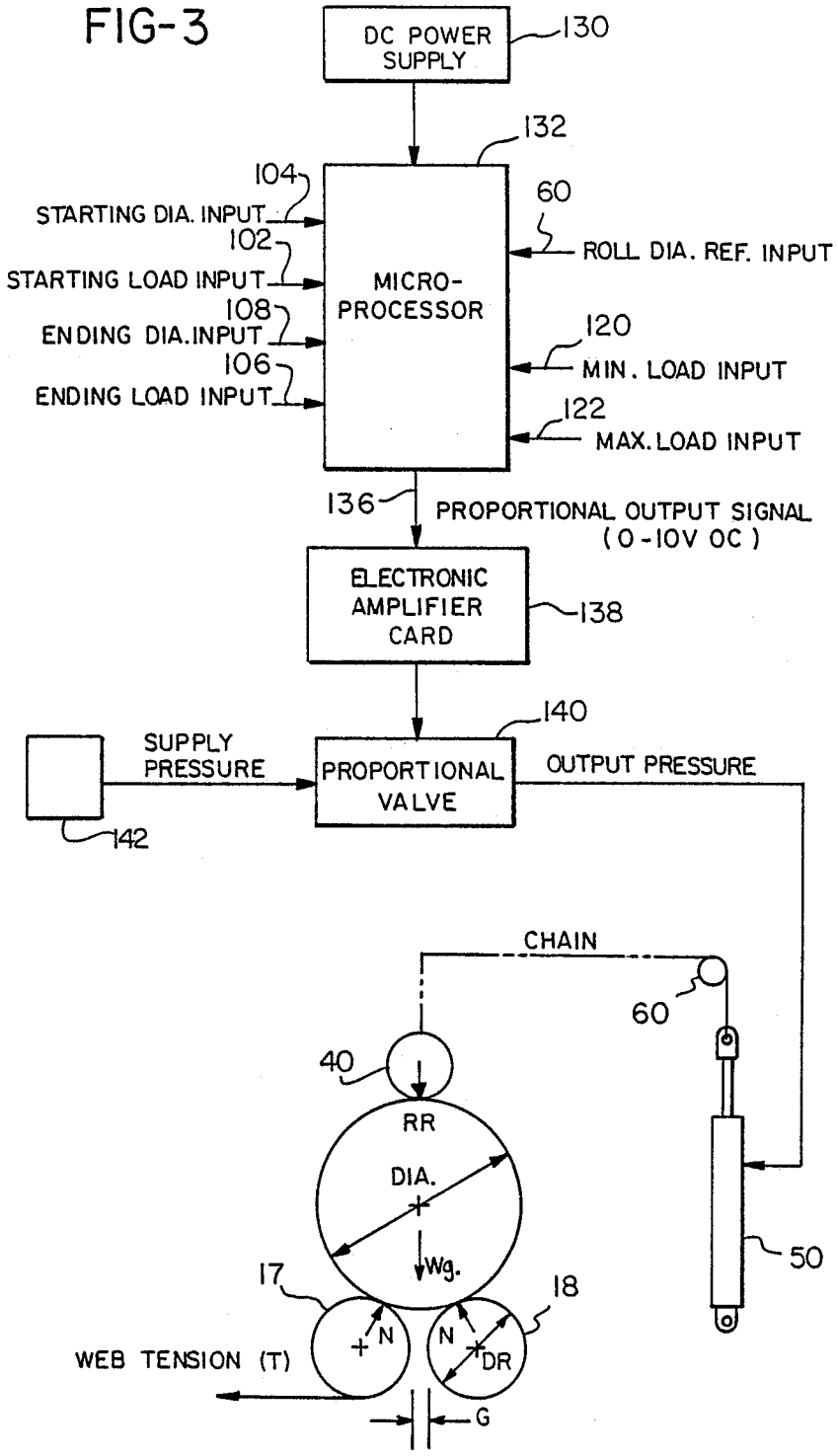
FIG. 3 is a block diagram showing the various major components comprising this invention.

FIG. 3 is a block diagram showing the various major components included in this invention. Power to the system is provided by a DC power supply 130. A microprocessor 132 receives control signals from the thumbwheel switches represent starting load 102, starting diameter 104, ending load 106, ending diameter 108, minimum load 120, and the roll diameter potentiometer. These signals are processed by the microprocessor in accordance with an algorithm that calculates the relieving action between the starting and ending diameters and loads. The resulting output signal 136 is applied through an amplifier 138 to a proportional valve 140 which in turn controls the flow of hydraulic pressure from a source 142 to the cylinder 150. The proportional valve 140 in the preferred embodiment of the invention is a type DRE/DREM (DREM 10-50/100 YM G 2424) proportional valve manufactured by Rexroth.

The microprocessor 132 reads the input signal 102 from the control panel 100 indicating the amount of desired pressure or load the rider roll 40 is expected to apply to the web or winding roll 30 at the start of winding. The output of the microprocessor is a signal controlling the position of the proportional pneumatic or hydraulic pressure valve 50,. which in turn loads or relieves the rider roll 40. This pressure is held constant until the winding roll 30 reaches the diameter which has been inputted into the microprocessor by the thumbwheel switch 104.

The diameter DIA of the web roll is calculated by the microprocessor 132 from the external input signal provided by the potentiometer 60 connected to the rider roll system. While it is possible to measure the winding roll's diameter directly, it has been found more convenient to merely obtain a resistance reading from a multiturn potentiometer 60 and to calculate the diameter using the following formula, where X is the distance between the top of the web roll and a line between the centers of the winding drums, V is the distance between the center of the web roll and a line between the center of the winding drums, H is the distance between the center of the drive rolls and the top surface of the web roll, DR is the diameter of the winding drum, G is the gap between the winding drums, and B is the distance between the center of one winding drum and the vertical line passing through the center of the web roll. As will be apparent to those skilled in the art, the X dimension may be derived directly from the position of the potentiometer 60.

$$DIA=(4X^2+2DR(G)+G^2)/(2DR+4X)$$

The microprocessor 132 then begins to calculate the change in the force RR exerted by the rider roll 40, which is proportional to the change in the nip load N created by the weight Wg of the winding roll or rolls on the winding drum or drums 17, 18.

The formula written below is provided to show how the rider roll pressure is calculated in terms of the nip load N of the weight RR from the rider roll 40 and the winding roll's weight Wg determined by: the specific web tension T to be wound, the coefficient of friction between the drum and the web material u, the drum's diameter DR, the gap between the drum G and the density DEN and web width WW of the material being wound.

$$RR = \frac{T}{u}\left[\frac{\sqrt{(DIA+DR)^2-(DR+G)^2}}{(DIA+DR)} - .785\,DIA^2 \times DEN\right] \times WW$$

The diameter and (calculated) nip load signals are scaled and output to digital meters 110 and 112 on the operator's control panel 100 (FIG. 2). If desired, a direct pressure roll force signal from a transducer connected to the pressure roll can be scaled and substituted as the signal to the rider roll load meter 112.

A voltage or amperage signal change 136 proportional to the calculated required pressure roll force change is produced and outputted to the proportional valve 140. This signal then produces a proportional change in the output pneumatic or hydraulic pressure from the valve 140 which results in the desired pressure roll or rider roll loading.

This proportional pressure roll or rider roll load is continuously calculated and produced until the winding roll's diameter reaches the input ending load diameter 108. At that point, the calculation reaches the ending load input 106.

The program resets its calculating automatically each time the pressure roll is returned to the start position. Another feature of this invention is that the load of the pressure roll can be changed by the operator at any point during the winding cycle. While winding, the operator can change the diameter and load settings 102,104,106,108. When the change is desired, the operator presses the "reset" spring-loaded rocker switch 114. A red light 116 will illuminate while the system is recalculating the new load curve. During this short time, the rider roll load remains at the last calculated setting. After the recalculating is completed, the "ready to run" green light 118 is re-illuminated and the recalculated pressure roll or rider roll load is produced.

Figure 4:
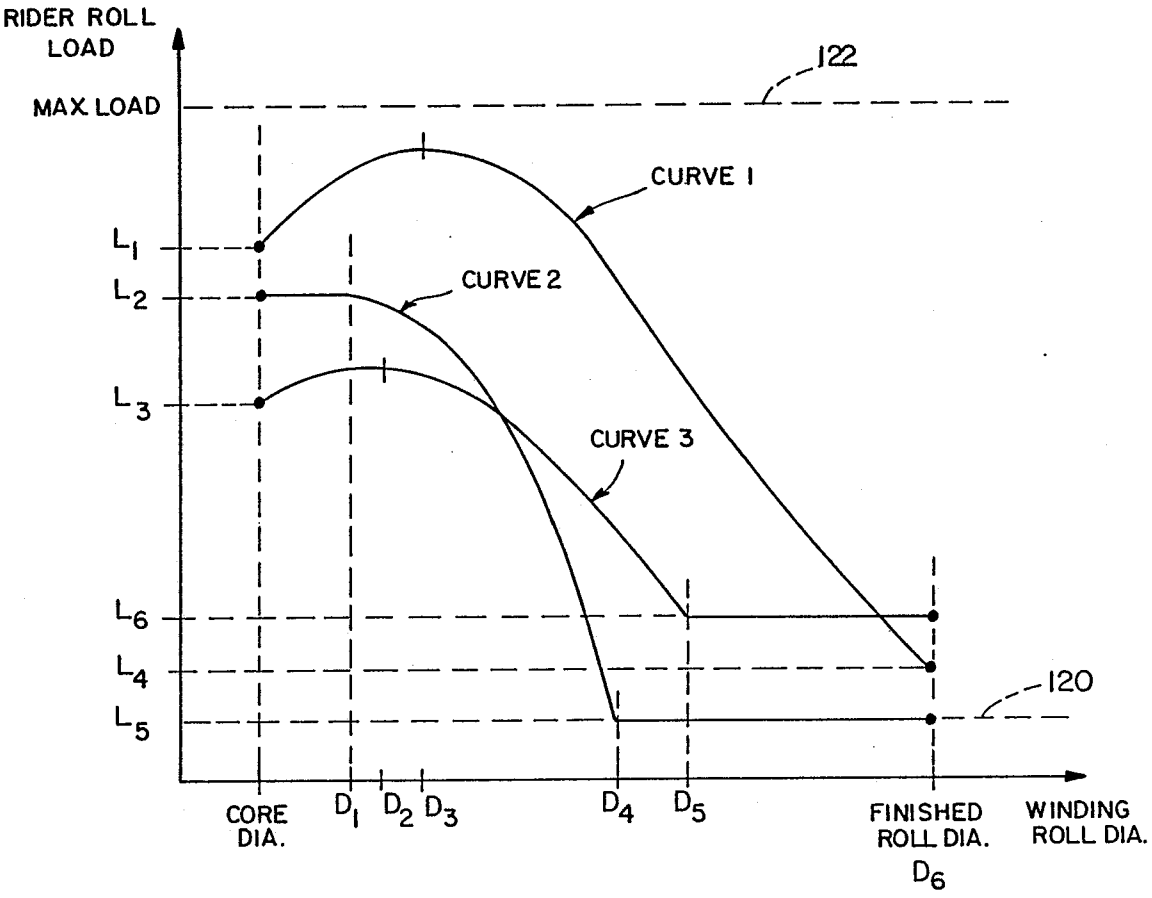
FIG. 4 is a waveform diagram showing the relationship between the winding roll diameter and the rider roll load under three different conditions.

Curve 1 in FIG. 4 represents heavy loading to produce a hard roll. The rider roll pressure begins at pressure L1 and increases from the beginning of the winding operation at the core diameter to near the maximum available pressure at diameter D3, where it then begins to decrease steadily to a rider roll load pressure L4 at the finish roll diameter as established by thumbwheel switches 106.

Curve 2 represents medium-to-hard loading in accordance with the present invention. The rider roll load L2 is constant from the start of winding on the core until the winding roll diameter reaches the first predetermined diameter D1 set by switches 104, and thereafter, the load decreases along curve 2 until it reaches the second predetermined diameter D4 at a specified minimum or ending rider roll load L5, and then the load continues constant until the winding operation is complete. It should be noted that the minimum load will be no less than that specified on the control panel at 120, but it may be a higher value if such higher value is set into the thumbwheel switches 106.

Curve 3 shows medium rider roll loading L3 at the beginning of the winding operation with the load increasing slightly until it reaches diameter D3, then the load decreases to the load L6 specified by thumbwheel switches 106 at the diameter D5 set by switches 108. Thereafter, the load will remain constant at value L6 until the roll is completely wound.

For many winding operations, it is undesirable for the pressure roll to lift off the winding rolls during the winding process. As a safeguard against this, this invention accepts a signal 120 which is externally programmable as a set-up function to limit the minimum load or which can be produced by the system. The maximum obtainable rider roll load 122 of the system can also be programmed into the microprocessor.

A quick and convenient diagnostic feature is also incorporated into this invention. A double direction spring-loaded rocker switch 124 is provided. When pushed up, the supply power voltage is displayed on the "Rider Roll Load" meter 112. When pushed down, the signal proportional to the load which is output to the converter valve 6 is displayed on the meter. When the switch is released, the meter switches back to reading the rider roll load.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. In a rider roll relieving system including
a pair of winding drums,
a core on which a web is wound with the aid of the winding drums,
a rider roll for applying pressure to the core, and the web as it is wound on the core, to control the internal tension of the web, and
means for controlling the pressure applied by the rider roll to the web,
the improvement comprising,
means for sensing the diameter of the web as it is wound onto the core,
means for selecting a first diameter where rider roll relieving action is to be commenced,
means for selecting a maximum rider roll pressure,
means for setting a second, larger diameter where rider roll relieving action is to be terminated,
means for setting a minimum rider roll pressure to be maintained after the relieving action is terminated,
means for providing control signals to said rider roll pressure controlling means for providing a pressure relieving action by controlling the rider roll pressure as a function of the diameter of the web to provide continuous rider roll pressure reduction as the web is wound between said first diameter and said second diameter while maintaining said maximum rider roll pressure until said first diameter is reached and maintaining said minimum rider roll pressure after said second diameter is reached.

2. The rider roll relieving system of claim 1 wherein said rider roll pressure reduction takes place between the first and second web diameters in accordance with the following formula, wherein
RR is rider roll pressure,
T is web tension as it enters the winding drum,
u is coefficient of friction between the web and the winding drum,
G is the gap between the winding drums,
DR is the winding drum diameter,
DIA is the web diameter,
DEN is density of the web material, and
WW is web width:

$$RR = \frac{T}{u}\left[\frac{\sqrt{(DIA+DR)^2-(DR+G)^2}}{(DIA+DR)} - .785\,DIA^2 \times DEN\right] \times WW$$

3. The rider roll relieving system of claim 1 further including means for displaying the pressure the rider roll is applying to the web.

4. The rider roll relieving system of claim 1 further including means responsive to a change in any of the means for setting or selecting the first diameter, the maximum rider roll pressure, the second diameter and the minimum rider roll pressure, and for recalculating the control signals for relieving rider roll pressure in accordance with the diameter of the web as it is being wound.

5. The rider roller relieving system of claim 1 further including means for maintaining rider roll pressure at a constant value during such time as the rider roll pressure reduction calculations are being made.

* * * * *